US007250716B2

(12) United States Patent
Fran et al.

(10) Patent No.: US 7,250,716 B2
(45) Date of Patent: Jul. 31, 2007

(54) COLD CATHODE FLAT FLUORESCENT LAMP AND PATTERNED ELECTRODE THEREOF

(75) Inventors: Yui-Shin Fran, Hsinchu (TW); Kung-Tung Pan, Taichung (TW); Chun-Hui Tsai, Hsinchu (TW)

(73) Assignee: Delta Optoelectronics, Inc., Hsin-Chu (TW)

( * ) Notice: Subject to any disclaimer, the term of this patent is extended or adjusted under 35 U.S.C. 154(b) by 251 days.

(21) Appl. No.: 11/138,613

(22) Filed: May 25, 2005

(65) Prior Publication Data

US 2006/0012305 A1 Jan. 19, 2006

(30) Foreign Application Priority Data

Jul. 14, 2004 (TW) ..... 93120945 A

(51) Int. Cl.
*H01J 17/04* (2006.01)

(52) U.S. Cl. ..... 313/491; 313/631

(58) Field of Classification Search ..... 313/491, 313/631, 632

See application file for complete search history.

(56) References Cited

FOREIGN PATENT DOCUMENTS

JP 2006032330 A * 2/2006

* cited by examiner

*Primary Examiner*—Vip Patel
(74) *Attorney, Agent, or Firm*—J.C. Patents

(57) ABSTRACT

A cold cathode flat fluorescent lamp (CCFFL) comprising a flat lamp chamber, fluorescent substance, discharge gas, and a patterned electrode is provided. The discharge gas is disposed in the gas discharge chamber. The fluorescent substance is disposed over the inner wall of the gas discharge chamber. The patterned electrode is disposed over a surface of the flat lamp chamber. In an embodiment, the patterned electrode comprises anode pairs and cathode pairs which are alternately arranged. Each anode pair comprises a first meandering anode with first protrusions and a second meandering anode with second protrusions, wherein the first protrusions and the second protrusions are staggered. Each cathode pair comprises a first meandering cathode with third protrusions and a second meandering cathode with fourth protrusions, wherein each third protrusion aligns with each second protrusion, and each fourth protrusion aligns with each first protrusion.

31 Claims, 5 Drawing Sheets

COLD CATHODE FLAT FLUORESCENT LAMP AND PATTERNED ELECTRODE THEREOF

CROSS-REFERENCE TO RELATED APPLICATION

This application claims the priority benefit of Taiwan application serial no. 93120945, filed on Jul. 14, 2004. All disclosure of the Taiwan application is incorporated herein by reference.

BACKGROUND OF THE INVENTION

1. Field of the Invention

The present invention relates to a cold cathode flat fluorescent lamp (CCFFL), and more particularly to a patterned electrode of a CCFFL.

2. Description of the Related Art

With the advance of technology, digital devices, such as mobile phones, digital cameras, digital video cameras, notebooks, and desktops are developed to have convenience, multiple functions and attractive designs. Display monitors of mobile phones, digital cameras, digital video cameras, notebooks, and desktops are essential interfaces between users and devices. Through the display monitors, users can conveniently use the devices. In recent years, display monitors of mobile phones, digital cameras, digital video cameras, notebooks, and desktops are liquid crystal display (LCD) panels, which, however, are not self-luminant. Therefore, a back-light module is disposed under a LCD panel to provide a light source to achieve the display purpose.

Having good luminance efficiency and uniformity, and the ability to provide a large-scale light source, the cold cathode flat fluorescent lamp (CCFFL) has been widely applied to the back-light module of LCD panels and other fields. A CCFFL is a plasma luminance device. By emitting electrons from a cathode to collide with inert gas between a cathode and an anode within a flat lamp chamber, the inert gas is ionized and excited to generate plasma. The excited atoms of the plasma return to the ground state by radiating ultraviolate (UV) light. The UV light then excites fluorescent substance in the CCFFL to generate visible light.

FIG. 1 is a schematic drawing showing a conventional CCFFL. Referring to FIG. 1, the conventional CCFFL comprises a flat lamp chamber 100, fluorescent substance 102, discharge gas 104, a patterned electrode 106, and a dielectric layer 108. Wherein, the flat lamp chamber 100 comprises flat substrates 100*a* and 100*b*, and edge stripes 100*c*. The edge stripes are disposed between the flat substrates 100*a* and 100*b*, and connect with the edges of the flat substrates 100*a* and 100*b* to form a sealed chamber.

Referring to FIG. 1, the material of the conventional patterned electrode 106 is usually silver, and the patterned electrode 106 is disposed over the flat substrate 100*a*. Usually, the dielectric layer 108 covers the patterned electrode 106 to protect the patterned electrode 106 from damage from ion collision. From FIG. 1, it is known that the patterned electrode 106 and the dielectric layer 108 thereon are on the inner wall of the flat lamp chamber 100. The discharge gas 104 is then injected in the flat lamp chamber 100. Usually, the discharge gas 104 is Xe, Ne, Ar, or other inert gas. In addition, the fluorescent substance 102 is disposed on the inner wall of the flat lamp chamber 100, for example, on the surface of the flat substrate 100*b*, the surface of the dielectric layer 108, and the surface of the flat substrate 100*a*, which is not covered by the dielectric layer 108, for example.

When the CCFFL is lit up, electrons emitted from the patterned electrode 106 collide with the discharge gas 104 in the flat lamp chamber 100 so that the discharge gas 104 is ionized to generate plasma. The excited atoms of the plasma return to the ground state by radiating UV light. The UV light then excites the fluorescent substance 102 on the inner wall of the flat lamp chamber 100 to generate visible light. In the luminance mechanism described above, however, the high-energy ions of the plasma would penetrate the dielectric layer 108 and damage the patterned electrode 106. As a result, the life time of the CCFFL is substantially reduced.

FIG. 2 is a schematic drawing showing a patterned electrode of a conventional CCFFL. Referring to FIG. 2, the patterned electrode of the conventional CCFFL comprises a plurality of meandering anodes 210, and a plurality of meandering cathodes 220. Because the meandering anodes 210 and the meandering cathodes 220 have sin-waveform designs, ideally, the meandering anodes 210 and the meandering cathodes 220 generate plasma in the luminance areas 230*a* and 230*b*. However, the luminance areas 230*a* and 230*b* are driven by the same meandering cathode 220 so that the luminance area 230*a* is lit up, but the luminance area 230*b* is not. In other words, sharing the same meandering cathode 220 or the same meandering anode 210 usually means only one of the two sides of the meandering cathode 220 or the meandering anode 210 is lit up. As a result, a dark-bright pattern would appear on the CCFFL, thus deteriorating the uniformity of the light source.

SUMMARY OF THE INVENTION

Accordingly, the present invention is directed to a cold cathode flat fluorescent lamp (CCFFL) capable of efficiently improving the uniformity of light source.

The present invention is also directed to a patterned electrode of a cold cathode flat fluorescent lamp capable of efficiently improving the uniformity of light source.

In order to achieve the objects described above, the present invention provides a cold cathode flat fluorescent lamp. The cold cathode flat fluorescent lamp comprises a flat lamp chamber, discharge gas, fluorescent substance, and a patterned electrode. Wherein, the discharge gas is disposed in the flat lamp chamber. The fluorescent substance is disposed over the inner wall of the flat lamp chamber. The patterned electrode can be formed over an inner surface or an outer surface of the flat lamp chamber by a printing method, for example. In addition, the patterned electrode can be a flexible printed circuit (FPC) attached to the outer surface of the flat lamp chamber. In this embodiment, the patterned electrode comprises anode pairs and cathode pairs, which are alternately arranged. Wherein, each anode pair comprises a first meandering anode with a plurality of first protrusions, and a second meandering anode with a plurality of second protrusions. The first protrusions and the second protrusions are staggered. Each cathode pair comprises a first meandering cathode with a plurality of third protrusions, and a second meandering cathode with a plurality of fourth protrusions. Wherein, each third protrusion aligns with one of the second protrusions, and each fourth protrusion aligns with one of the first protrusions.

The present invention provides a patterned electrode of a cold cathode flat fluorescent lamp. The patterned electrode of the cold cathode flat fluorescent lamp comprises anode pairs and cathode pairs, which are alternately arranged.

Wherein, each anode pair comprises a first meandering anode with a plurality of first protrusions, and a second meandering anode with a plurality of second protrusions. The first protrusions and the second protrusions are staggered. Each cathode pair comprises a first meandering cathode with a plurality of third protrusions, and a second meandering cathode with a plurality of fourth protrusions. Wherein, each third protrusion aligns with one of the second protrusions, and each fourth protrusion aligns with one of the first protrusions.

According to an embodiment of the present invention, the patterned electrode further comprises an anode connecting line and a cathode connecting line. Wherein, the anode connecting line is electrically connected to each anode pair. The cathode connecting line is electrically connected to each cathode pair. In addition, the anode connecting line and the cathode connecting line are disposed at two sides of the anode pairs and the cathode pairs, respectively.

In the present invention, the anode pairs and the cathode pairs are alternately arranged, thus luminous areas on two sides of each anode pair and cathode pair have efficient luminescence. Luminescence uniformity is thus achieved.

The above and other features of the present invention will be better understood from the following detailed description of the embodiments of the invention that is provided in communication with the accompanying drawings.

DESCRIPTION OF SOME EMBODIMENTS

Figure 1:
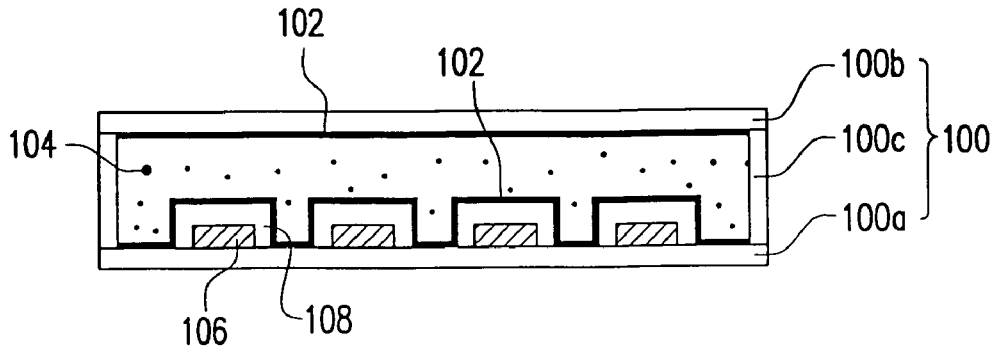
FIG. 1 (PRIOR ART)
FIG. 1 is a schematic drawing showing a conventional CCFFL.
Figure 2:
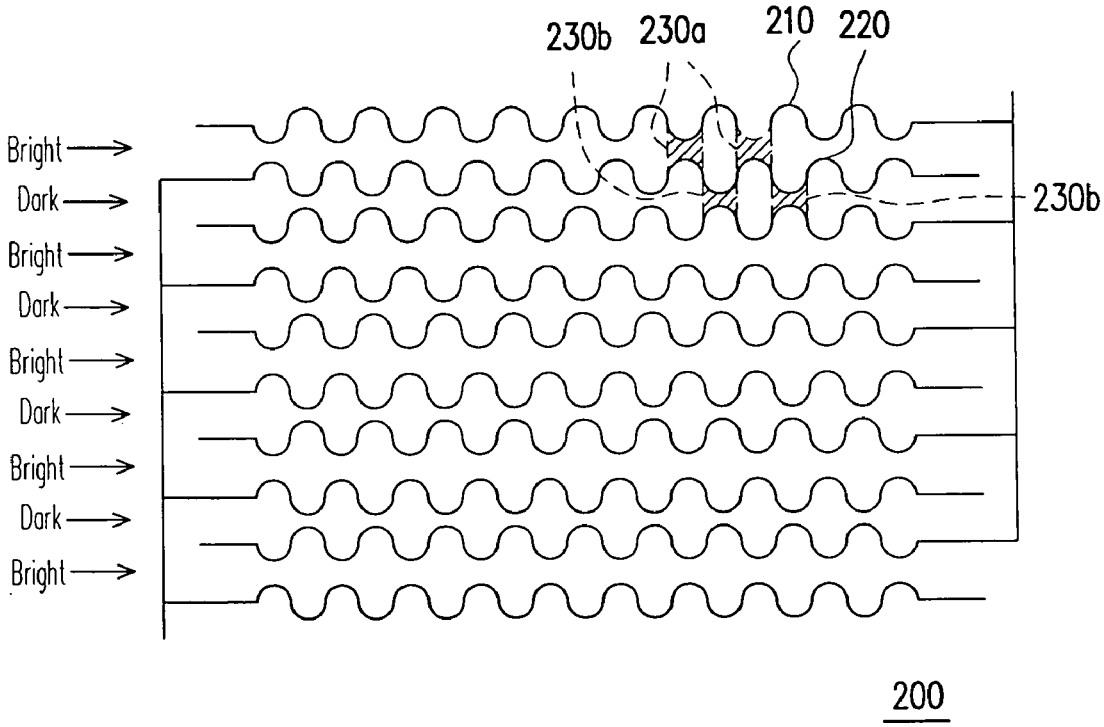
FIG. 2 (PRIOR ART)
FIG. 2 is a schematic drawing showing a patterned electrode of a conventional CCFFL.
Figure 3:
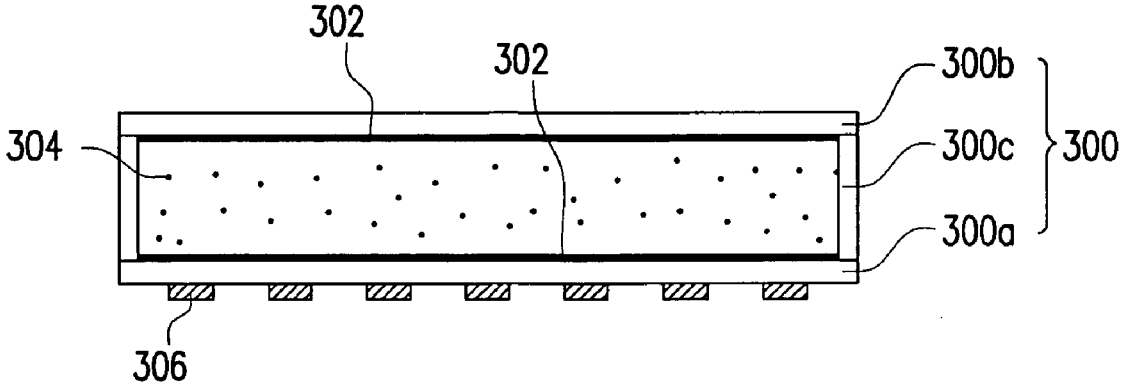
FIG. 3 is a schematic drawing showing a cold cathode flat fluorescent lamp (CCFFL) according to an embodiment of the present invention.

FIG. 3 is a schematic drawing showing a cold cathode flat fluorescent lamp (CCFFL) according to an embodiment of the present invention. Referring to FIG. 3, the cold cathode flat fluorescent lamp of the present invention comprises a flat lamp chamber 300, fluorescent substance 302, discharge gas 304, and a patterned electrode 306.

In this embodiment, the material of the flat lamp chamber can be, for example, glass. In detail, the flat lamp chamber 300 comprises a flat substrate 300*a*, a flat substrate 300*b*, a plurality of edge stripes 300*c*, for example. The flat substrate 300*b* is disposed over the flat substrate 300*a*. The edge stripes 300*c* are disposed between the flat substrates 300*a* and 300*b*, and connect with the edges of the flat substrates 300*a* and 300*b*. One of ordinary skill in the art will know that the flat lamp chamber 300 may include other structures. In this embodiment, the thickness of the flat substrate 300*a* is from about 0.3 mm to about 1.1 mm, for example. The distance between the flat substrates 300*a* and 300*b* can be, for example, from about 0.5 mm to about 5.0 mm.

In this embodiment, the fluorescent substance 302 is disposed over the inner wall of the flat lamp chamber 300. The fluorescent substance 302 usually is disposed over the surfaces of the flat substrates 300*a* and 300*b*. The discharge gas 304 is disposed in the flat lamp chamber 300, and the discharge gas 304 can be, for example, Xe, Ne, or Ar.

Figure 4:
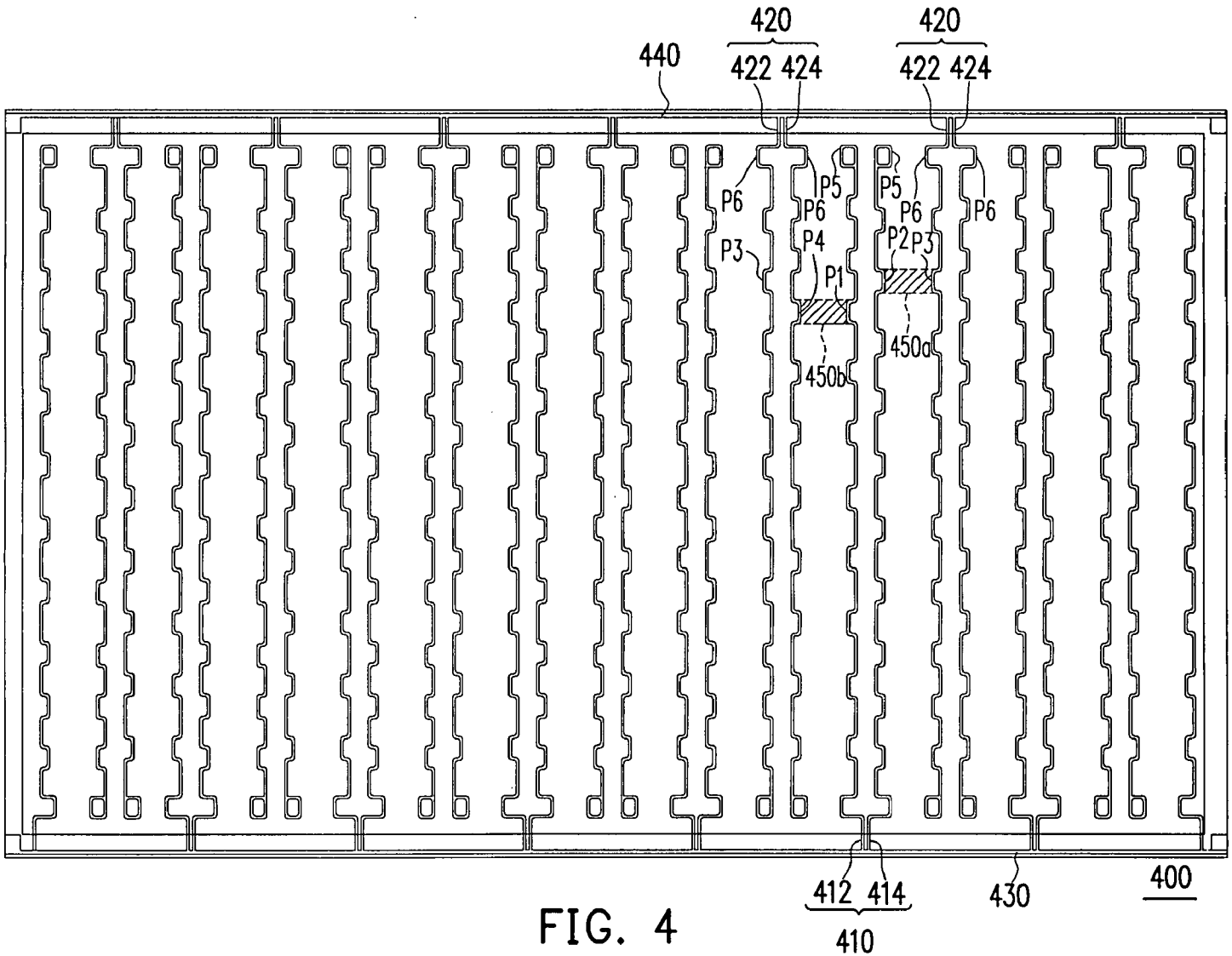
FIGS. 4 and 5 are schematic drawings showing a patterned electrode of a cold cathode flat fluorescent lamp according to an embodiment of the present invention.
Figure 5:
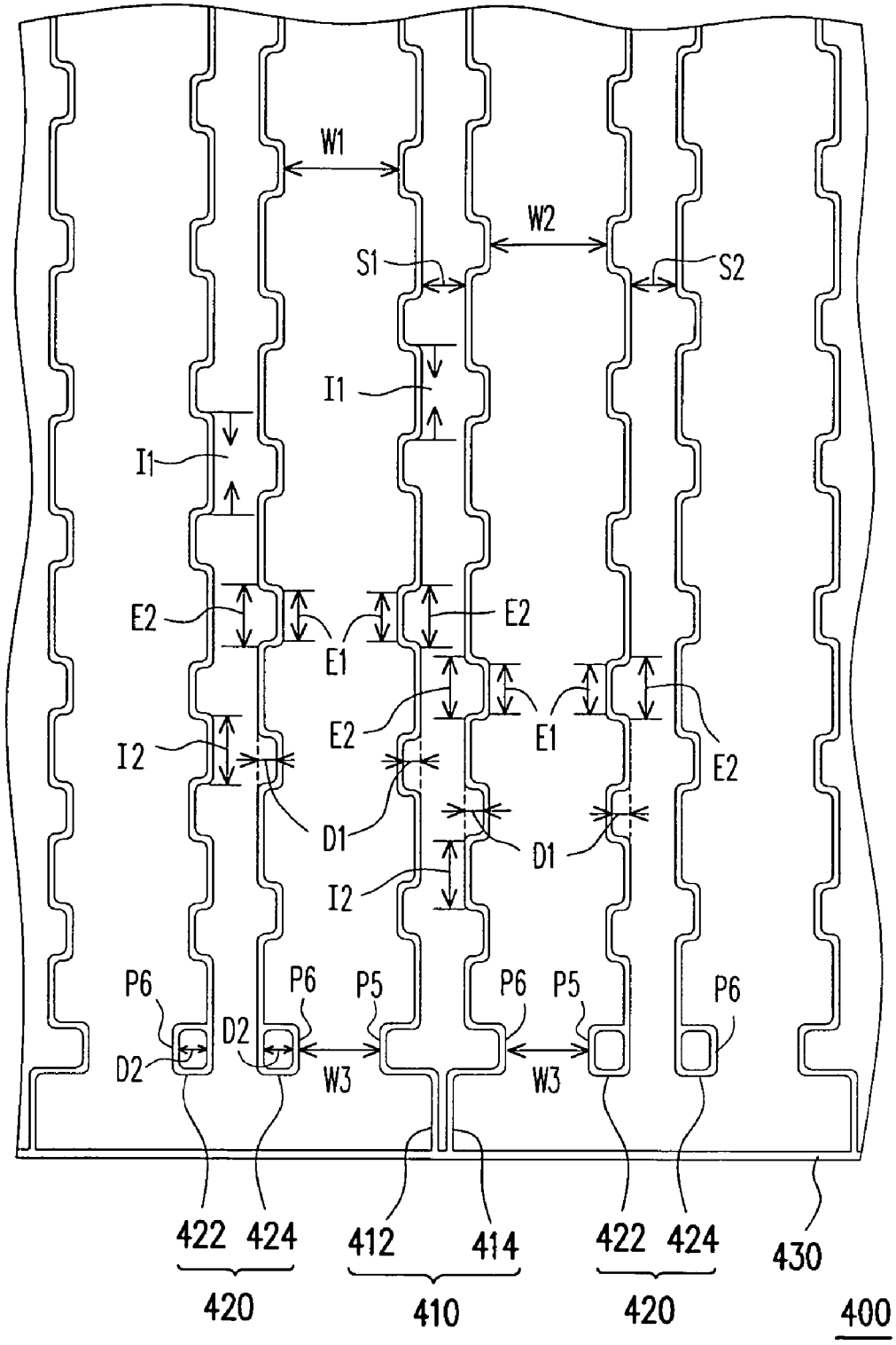

FIGS. 4 and 5 are schematic drawings showing a patterned electrode of a cold cathode flat fluorescent lamp according to an embodiment of the present invention. Referring to FIG. 4, the patterned electrode 400 of the present invention comprises anode pairs 410 and cathode pairs 420, which are alternately arranged. Wherein, each anode pair 410 comprises a first meandering anode 412 with a plurality of first protrusions P1, and a second meandering anode 414 with a plurality of second protrusions P2. The first protrusions P1 and the second protrusions P2 are staggered. In addition, each cathode pair 420 comprises a first meandering cathode 422 with a plurality of third protrusions P3, and a second meandering cathode 424 with a plurality of fourth protrusions P4. The third protrusions P3 and the fourth protrusions P4 are staggered.

Note that each third protrusion P3 of the cathode pair 420 aligns with one of the second protrusions P2 of the anode pair 410, and each fourth protrusion P4 of the cathode pair 420 aligns with one of the first protrusions P1 of the anode pair 410. In detail, the area between the third protrusions P3 of the cathode pair 420 and the second protrusions P2 of the anode pair 410 is a luminance area 450*a*, and the area between the fourth protrusions P4 of the cathode pair 420 and the first protrusions P1 of the anode pair 410 is a luminance area 450*b*. The luminance areas 450*a* and 450*b* are driven by different cathodes and anodes. When the cold cathode flat fluorescent lamp illuminates, the dark-bright pattern caused by the common anodes or cathodes would not occur. The uniformity of the light source is also substantially improved.

In this embodiment, all protrusions, including the first protrusions P1, the second protrusions P2, the third protrusions P3, and the fourth protrusions P4, can be arranged with equal distances. Of course, the protrusions can be arranged with difference distances depending on the location thereof. Referring to FIGS. 4 and 5, the first protrusions P1, the second protrusions P2, the third protrusions P3, and the fourth protrusions P4, which are close to the edge of the cold cathode flat fluorescent lamp, are arranged with smaller spaces. In this embodiment, the distance I2 of all protrusions, including the first protrusions P1, the second protrusions P2, the third protrusions P3, and the fourth protrusions P4, which are close to the edge of the cold cathode flat fluorescent lamp, can be from about 2 mm to about 4 mm. The preferred distance is about 3 mm. The distance I1 of all protrusions which are close to the center of the cold cathode flat fluorescent lamp can be, for example, from about 3 mm to about 6 mm. The preferred distance is about 4.4 mm.

In order to improve the uniformity of the light source, in this embodiment, the edge protrusions P5 and P6 with higher protruding parts are formed at the ends of the anode pairs 410 and cathode pairs 420. In other words, the protruding height D2 of the edge protrusions P5 and P6 are higher than the protruding height D1 of the first protrusions P1, the second protrusions P2, the third protrusions P3, and the fourth protrusions P4. In an embodiment of the present invention, the protruding height D1 of the first protrusions P1, the second protrusions P2, the third protrusions P3, and the fourth protrusions P4 can be, for example, from about 0.5 mm to about 2 mm. The preferred height is about 1 mm. The protruding height of the edge protrusions P5 and P6 can be, for example, from about 1 mm to about 3 mm. The preferred height is about 2 mm.

In this embodiment, the distance W1 between the first protrusions P1 and the fourth protrusions P4 of the different polarity electrodes can be, for example, from about 4 mm to about 8 mm. Its preferred distance is about 6.3 mm. The distance W2 between the second protrusions P2 and the third protrusions P3 of the different polarity electrodes can be, for example, from about 4 mm to about 8 mm. Its preferred distance is about 6.3 mm. The distance W3 between the edge protrusions P5 and P6 of the different polarity electrodes can be, for example, from about 3 mm to about 5 mm. Its preferred distance is about 4 mm.

Referring to FIGS. 4 and 5, in the same anode pair 410, the distance S1 between the same polarity electrodes of the first meandering anode 412 and the second meandering anode 414 can be, for example, from about 1 mm to about 3 mm. The preferred distance is about 2 mm. In addition, in the same cathode pair 420, the distance S2 between the same polarity electrodes of the first meandering anode 422 and the second meandering anode 424 can be, for example, from about 1 mm to about 3 mm. The preferred distance is about 2 mm.

In this embodiment, the electrode functional width E1 of the first protrusions P1, the second protrusions P2, the third protrusions P3, and the fourth protrusions P4 can be, for example, from 0.5 mm to about 2 mm. The preferred width is about 1 mm. In addition, the electrode-opening maximum width E2 of the first protrusions P1, the second protrusions P2, the third protrusions P3, and the fourth protrusions P4 can be, for example, from 1 mm to about 4 mm. The preferred width is about 3 mm.

The patterned electrode 400 of the present invention further comprises an anode connecting line 430 and a cathode connecting line 440, for example. Wherein, the anode connecting line 430 connects with each anode pair 410, and the cathode connecting line 440 connects with each cathode pair 420. In addition, the anode connecting line 430 and the cathode connecting line 440 are disposed at two sides of the anode pairs 410 and the cathode pairs 420, respectively.

Note that the patterned electrode 400 of the present invention can be formed over the inner or outer surface of the flat lamp chamber 300. In detail, the patterned electrode 400 can be, for example, a silver electrode or a copper electrode which is formed over the inner surface of the flat lamp chamber 300 by a printing method or other thick film methods. Of course, the patterned electrode 400 can be, for example, a silver electrode or a copper electrode which is formed over the outer surface of the flat lamp chamber 300 by a printing method or other thin film methods. In addition, the patterned electrode 400 of the present invention can be, for example, a silver electrode or a copper electrode formed over a flexible substrate. In other words, the patterned electrode 400 of the present invention can be a flexible printed circuit (FPC), for example, so that it can be easily attached to the outer surface of the flat lamp chamber 300.

Figure 6:
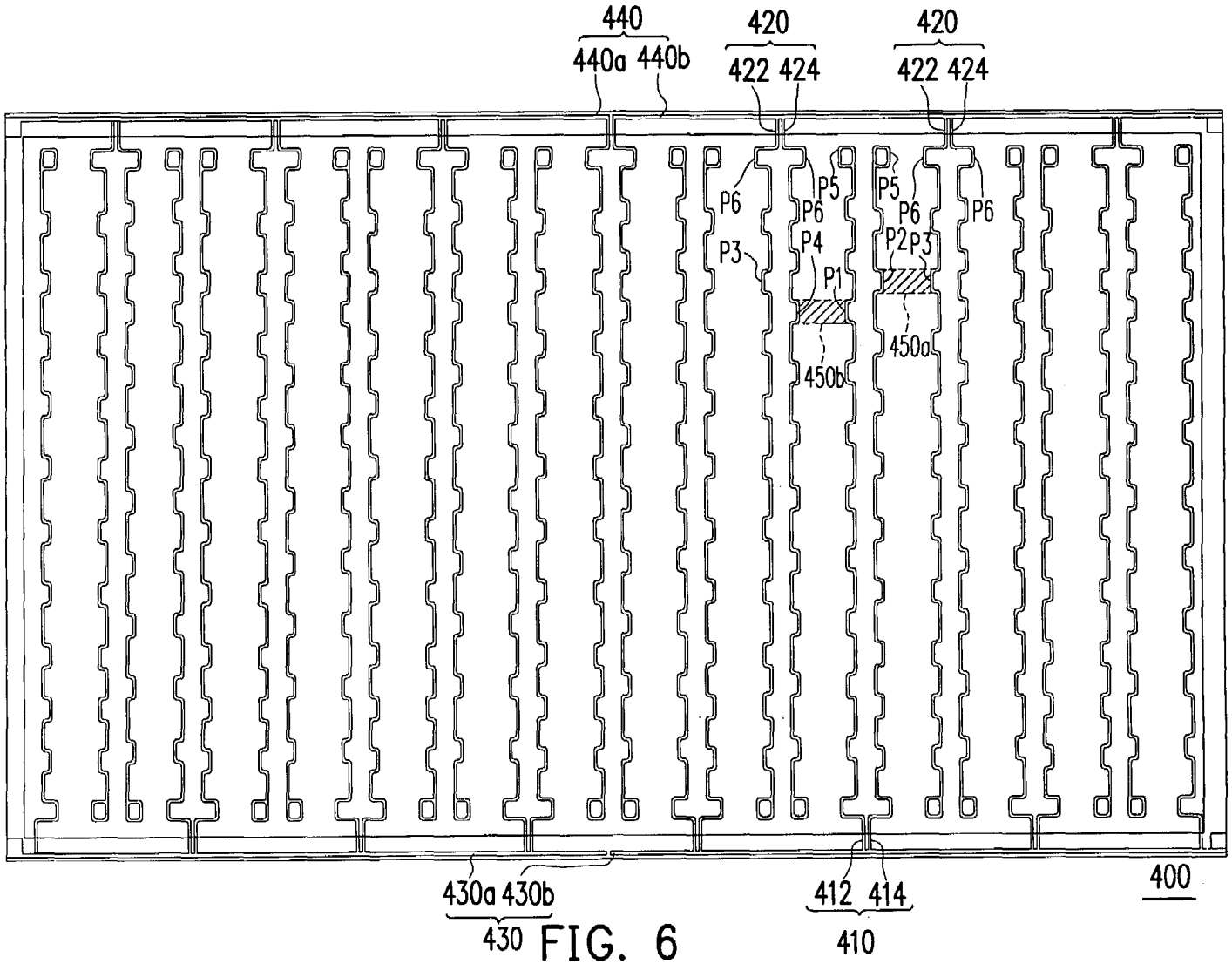
FIG. 6 is a schematic drawing showing a patterned electrode according to another embodiment of the present invention.

FIG. 6 is a schematic drawing showing a patterned electrode according to another embodiment of the present invention. Referring to FIG. 6, the anode connecting line 430 of this embodiment comprises sub-connecting lines 430*a* and 430*b*, and the cathode connecting line 440 comprises sub-connecting lines 440*a* and 440*b*, for example. Accordingly, the cold cathode flat fluorescent lamp can be driven through different sub-connecting lines 430*a*, 430*b*, 440*a*, and 440*b*. In this embodiment, the design of the anode connecting line 430 and the cathode connecting line 440 is applicable to a large-scale cold cathode flat fluorescent lamp. In detail, the cold cathode flat fluorescent lamp can be individually driven through inverters coupled to the sub-connecting lines 430*a*, 430*b*, 440*a*, and 440*b*.

The cold cathode flat fluorescent lamp of the present invention and the patterned electrode thereof have at least the following advantages:

1. The patterned electrode of the present invention can prevent the dark-bright pattern in the discharge area of the cold cathode flat fluorescent lamp. Accordingly, each luminance area can be lit up and the uniformity of the light source can also be improved.
2. The patterned electrode of the present invention can be formed as a flexible printed circuit (FPC). It can be formed apart from the flat lamp chamber. The yield is thus improved and manufacturing cost is reduced.
3. If the patterned electrode is formed over the outer surface of the cold cathode flat fluorescent lamp, the patterned electrode outside the flat lamp chamber generates plasma inside the flat lamp chamber. The excited atoms of the plasma will not damage the outside patterned electrode. The life time of the cold cathode flat fluorescent lamp can thus be enhanced.

Although the present invention has been described in terms of exemplary embodiments, it is not limited thereto. Rather, the appended claims should be constructed broadly to include other variants and embodiments of the invention which may be made by those skilled in the field of this art without departing from the scope and range of equivalents of the invention.

What is claimed is:

1. A cold cathode flat fluorescent lamp, comprising:

a flat lamp chamber;

discharge gas, disposed in the flat lamp chamber;

fluorescent substance, disposed in the flat lamp chamber; and a patterned electrode, disposed over a surface of the flat lamp chamber, the patterned electrode comprising:

a plurality of anode pairs, each anode pair comprising a first meandering anode with a plurality of first protrusions, and a second meandering anode with a plurality of second protrusions, wherein the first protrusions and the second protrusions are staggered; and a plurality of cathode pairs, the cathode pairs and the anode pairs being alternately arranged, each cathode pair comprising a first meandering cathode with a plurality of third protrusions, and a second meandering cathode with a plurality of fourth protrusions, wherein each third protrusion aligns with one of the second protrusions, and each fourth protrusion aligns with one of the first protrusions.

2. The cold cathode flat fluorescent lamp of claim 1, wherein the surface of the flat lamp chamber is an outer surface of the plate lamp chamber.

3. The cold cathode flat fluorescent lamp of claim 1, wherein the surface of the flat lamp chamber is an inner surface of the plate lamp chamber.

4. The cold cathode flat fluorescent lamp of claim 1, wherein the patterned electrode is a flexible printed circuit.

5. The cold cathode flat fluorescent lamp of claim 1, wherein a distance between the same polarity electrodes of the first meandering anode and the second meandering anode of each anode pair is from about 1 mm to about 3 mm.

6. The cold cathode flat fluorescent lamp of claim 1, wherein a distance between the same polarity electrodes of the first meandering cathode and the second meandering cathode of each cathode pair is from about 1 mm to about 3 mm.

7. The cold cathode flat fluorescent lamp of claim 1, wherein a distance between the second protrusions and the third protrusions of different polarity electrodes, and between the first protrusions and the fourth protrusions of different polarity electrodes is from about 4 mm to about 8 mm.

8. The cold cathode flat fluorescent lamp of claim 1, wherein a protruding height of the first protrusions, the second protrusions, the third protrusions, and the fourth protrusions is from about 0.5 mm to about 2 mm.

9. The cold cathode flat fluorescent lamp of claim 1, wherein the first protrusions, the second protrusions, the third protrusions, and the fourth protrusions are arranged with equal distances respectively.

10. The cold cathode flat fluorescent lamp of claim 9, wherein the distances between the first protrusions, the second protrusions, the third protrusions, and the fourth protrusions are from about 3 mm to about 6 mm respectively.

11. The cold cathode flat fluorescent lamp of claim 1, wherein the first protrusions, the second protrusions, the third protrusions, and the fourth protrusions are arranged with different distances respectively.

12. The cold cathode flat fluorescent lamp of claim 11, wherein a portion of the distances between the first protrusions, the second protrusions, the third protrusions, and the fourth protrusions are from about 3 mm to about 6 mm respectively, and the other portion of the distances between the first protrusions, the second protrusions, the third protrusions, and the fourth protrusions are from about 2 mm to about 4 mm respectively.

13. The cold cathode flat fluorescent lamp of claim 1, wherein electrode-functional widths of the first protrusions, the second protrusions, the third protrusions, and the fourth protrusions are from about 0.5 mm to about 2 mm respectively.

14. The cold cathode flat fluorescent lamp of claim 1, wherein electrode-opening maximum widths of the first protrusions, the second protrusions, the third protrusions, and the fourth protrusions are from about 1 mm to about 4 mm respectively.

15. The cold cathode flat fluorescent lamp of claim 1, further comprising a plurality of edge protrusions connected to ends of the anode pairs and the cathode pairs, the protruding height of the edge protrusions being larger than the protruding height of the first protrusions, the second protrusions, the third protrusions, and the fourth protrusions.

16. The cold cathode flat fluorescent lamp of claim 15, wherein the protruding height of the edge protrusions is from about 1 mm to about 3 mm.

17. The cold cathode flat fluorescent lamp of claim 1, wherein the patterned electrode further comprises:

an anode connecting line, electrically connected to each anode pair; and a cathode connecting line, electrically connected to each cathode pair, wherein, the anode connecting line and the cathode connecting line are disposed at two sides of the anode pairs and the cathode pairs, respectively.

18. A patterned electrode of a cold cathode flat fluorescent lamp, comprising:

a plurality of anode pairs, each anode pair comprising a first meandering anode with a plurality of first protrusions, and a second meandering anode with a plurality of second protrusions, wherein the first protrusions and the second protrusions are staggered; and a plurality of cathode pairs, the cathode pairs and the anode pairs being alternately arranged, each cathode pair comprising a first meandering cathode with a plurality of third protrusions, and a second meandering cathode with a plurality of fourth protrusions, wherein each third protrusion aligns with one of the second protrusions, and each fourth protrusions aligns with one of the first protrusions.

19. The patterned electrode of a cold cathode flat fluorescent lamp of claim 18, wherein a distance between the same polarity electrodes of the first meandering anode and the second meandering anode of each anode pair is from about 1 mm to about 3 mm.

20. The patterned electrode of a cold cathode flat fluorescent lamp of claim 18, wherein a distance between the same polarity electrodes of the first meandering cathode and the second meandering cathode of each cathode pair is from about 1 mm to about 3 mm.

21. The patterned electrode of a cold cathode flat fluorescent lamp of claim 18, wherein a distance between the second protrusions and the third protrusions of different polarity electrodes, and between the first protrusions and the fourth protrusions of different polarity electrodes is from about 4 mm to about 8 mm.

22. The patterned electrode of a cold cathode flat fluorescent lamp of claim 18, wherein a protruding height of the first protrusions, the second protrusions, the third protrusions, and the fourth protrusions is from about 0.5 mm to about 2 mm.

23. The patterned electrode of a cold cathode flat fluorescent lamp of claim 18, wherein the first protrusions, the second protrusions, the third protrusions, and the fourth protrusions are arranged with equal distances respectively.

24. The patterned electrode of a cold cathode flat fluorescent lamp of claim 23, wherein the distance between the first protrusions, the second protrusions, the third protrusions, and the fourth protrusions is from about 3 mm to about 6 mm respectively.

25. The patterned electrode of a cold cathode flat fluorescent lamp of claim 18, wherein the first protrusions, the second protrusions, the third protrusions, and the fourth protrusions are arranged with different distances respectively.

26. The patterned electrode of a cold cathode flat fluorescent lamp of claim of claim 25, wherein a portion of the distances between the first protrusions, the second protrusions, the third protrusions, and the fourth protrusions is from about 3 mm to about 6 mm, and the other portion of the distances between the first protrusions, the second protrusions respectively, the third protrusions, and the fourth protrusions is from about 2 mm to about 4 mm respectively.

27. The patterned electrode of a cold cathode flat fluorescent lamp of claim 18, wherein electrode-functional widths of the first protrusions, the second protrusions, the third protrusions, and the fourth protrusions is from about 0.5 mm to about 2 mm respectively.

28. The patterned electrode of a cold cathode flat fluorescent lamp of claim 18, wherein electrode-opening maximum widths of the first protrusions, the second protrusions, the third protrusions, and the fourth protrusions is from about 1 mm to about 4 mm respectively.

29. The patterned electrode of a cold cathode flat fluorescent lamp of claim 18, further comprising a plurality of edge protrusions connected to ends of the anode pairs and the cathode pairs, a protruding height of the edge protrusions being larger than the protruding height of the first protrusions, the second protrusions, the third protrusions, and the fourth protrusions.

30. The patterned electrode of a cold cathode flat fluorescent lamp of claim 29, wherein the protruding height of the edge protrusions is from about 1 mm to about 3 mm.

31. The patterned electrode of a cold cathode flat fluorescent lamp of claim 18, wherein the patterned electrode further comprises:

an anode connecting line, electrically connected to each anode pair; and a cathode connecting line, electrically connected to each cathode pair, wherein, the anode connecting line and the cathode connecting line are disposed at two sides of the anode pairs and the cathode pairs, respectively.

* * * * *